US007281511B2

(12) United States Patent
Quezada

(10) Patent No.: US 7,281,511 B2
(45) Date of Patent: Oct. 16, 2007

(54) AIR INTAKE FOR MOTOR VEHICLES

(76) Inventor: Anthony Quezada, 8759 Lion St., Rancho Cucamonga, CA (US) 91730

( * ) Notice: Subject to any disclaimer, the term of this patent is extended or adjusted under 35 U.S.C. 154(b) by 0 days.

(21) Appl. No.: 11/362,642

(22) Filed: Feb. 27, 2006

(65) Prior Publication Data

US 2006/0196462 A1 Sep. 7, 2006

(51) Int. Cl.
*F02M 35/10* (2006.01)

(52) U.S. Cl. ..... 123/184.53; 123/184.56; 123/184.21

(58) Field of Classification Search ..... 123/184.21, 123/184.56, 184.53
See application file for complete search history.

(56) References Cited

U.S. PATENT DOCUMENTS 1,727,265 A * 9/1929 Aseltine ..... 123/184.39
1,727,266 A * 9/1929 Aseltine ..... 123/184.39
5,048,237 A 9/1991 Atwood
5,383,356 A 1/1995 Zurek et al.
5,467,648 A 11/1995 Igarashi et al.
5,924,398 A * 7/1999 Choi ..... 123/184.21
6,101,869 A 8/2000 Kadohiro et al.
6,240,775 B1 6/2001 Uramachi et al.
6,467,359 B1 10/2002 Atwood
6,553,955 B1 * 4/2003 Hada et al. ..... 123/184.53
6,715,367 B1 4/2004 Gonzales et al.
7,000,583 B2 * 2/2006 Kino et al. ..... 123/184.53

* cited by examiner

*Primary Examiner*—Stephen K. Cronin
*Assistant Examiner*—Jason A Benton
(74) *Attorney, Agent, or Firm*—Lewis M. Brande; Thomas A. McCleary; Brande & McCleary

(57) ABSTRACT

This invention describes an improved intake tube for internal combustion vehicles by locally increasing and then decreasing the airflow over the Mass Airflow Sensor (MAS) preventing a lean condition, which over time is catastrophic to the life of the engine. The intake tube has a cross sectional area that decreases in proximity to the MAS, causing the increase in airflow velocity of the intake air.

1 Claim, 5 Drawing Sheets

AIR INTAKE FOR MOTOR VEHICLES

FIELD OF THE INVENTION

This invention relates to an improved induction system that will correct the lean air-fuel mixture problems that have occurred when the OEM induction tube has been replaced with an aftermarket induction system. The present invention eliminates the resultant lean air/fuel condition which will damage an engine, necessitating repair.

DESCRIPTION OF THE PRIOR ART

In U.S. Pat. No. 6,715,367 (Apr. 6, 2004) by Gonzales, et al. a mass air flow meter is described having an elongated hollow body with a venturi member. The novelty of this invention lies in channels formed in the outside surface of the venturi member with the channels directing the flow of the sample air through a first channel to the interior of the air flow meter and a second sample of air through a second channel for measurement of the airflow. A third annular channel recombines the air exiting from the second channel to be recombined with the main flow of air through the meter.

In U.S. Pat. No. 6,467,359 (Oct. 22, 2002) by Atwood, a mass air flow meter has a static pressure manifold upstream from an air flow path capable of accumulating a volume of air therein. The flow path is constructed to receive an air flow transducer and in communication with the main air flow traveling through the meter so that it's capable of sensing different static pressures. The static pressure manifold functions as a resultant average of the different static pressures and provides non-turbulent air flow to an engine.

In U.S. Pat. No. 6,101,869 (Aug. 15, 2000) by Kadohiro et al., an air flow rate measuring device for an internal combustion engine is disclosed. The device has a casing provided downstream for purifying intake air to the internal combustion engine, a duct connected to the casing and an air flow meter provided in the duct that measures an air flow rate taken into the engine.

In U.S. Pat. No. 5,467.648 (Nov. 21, 1995) by Igarashi et al., an air flow rate measuring device for measuring intake air flow rate for a fuel injector into an automobile engine is revealed. The device reduces any error attributable to variations from the air cleaner or the duct's air passage upstream from the device. In one of several variations of the device, for example, there is a main air passage for intake air; a sub-air passage permitting part of the air from the main passage to flow therethrough; flow rate measuring means in the sub-air passage; and pressure reduction means upstream of the outlet of the sub-air passage to reduce pressure in the main air passage around the outlet of the sub-air passage.

In U.S. Pat. No. 5,048,327 (Sep. 17, 1991) by Atwood, a structure for improving the flow dynamics of air flow through a sampling path is disclosed. The structure includes a sampling tube tapering with decreasing area in the direction of the air flow. Also, there is the equivalent of a low pass RC filter that decouples the high turbulence in the main air flow through a venturi, averages the turbulence and provides a scaled down flow through the sample tube for measurement by a transducer in the sample tube.

In U.S. Pat. No. 4,889,081 (Dec. 26, 1989) by Ozaki, a vehicle suction system for reducing the turbulence and pulsation of air flow to an internal combustion engine is shown. A rectifying unit is installed in the air intake passageway of a vehicle suction system, so that all air flow through the passageway flows through a face of the rectifying unit. The rectifying unit has a plurality of alternating wedge shaped partitions disposed in the face of the rectifying unit.

SUMMARY OF THE INVENTION

Generally the purpose of aftermarket components is to improve the visual appeal, the fuel efficiency, and/or the horsepower rating of the engine. The purpose of the present invention is to provide an improved induction system that will alleviate the lean air to fuel condition that occurs when the airflow of the induction system eliminates restrictions such as the air filter and plenum that the OEM place in close proximity to the engine.

In order to accomplish the above mentioned purpose, the present invention provides an intake tube that is adapted to fit in a particular internal combustion vehicle, such as a motorcar or truck. A plenum is attached to a firewall or front interior quarter panel of a vehicle. The plenum will contain an air filter, which is generally fabricated by an aftermarket manufacturer. The intake tube is connected to the plenum and to the engine. Proximate to the engine, provisions are incorporated in order to install the engine sensors, which generally include the MAS or Mass Airflow Sensors, and the breather hose fittings that are currently installed into the OEM induction system. The locations of the MAS and the breather tube in the instant invention are nearly identical to the locations on the OEM induction system. The intake tube will then direct the air flow to the engine.

The novelty of this invention is the insertion of a shaped restrictor sleeve or insert. The restrictor sleeve generally locally reduces the overall cross sectional area of the intake tube in close proximity to the engine sensors. This essentially increases the overall velocity and density of the air charge as it passes the MAS, providing the vehicle's computer with the correct information allowing the computer to provide the engine with the correct fuel requirements, which ultimately prevents the lean condition of a straight and unmodified tube.

DETAILED DESCRIPTION

Figure 1:
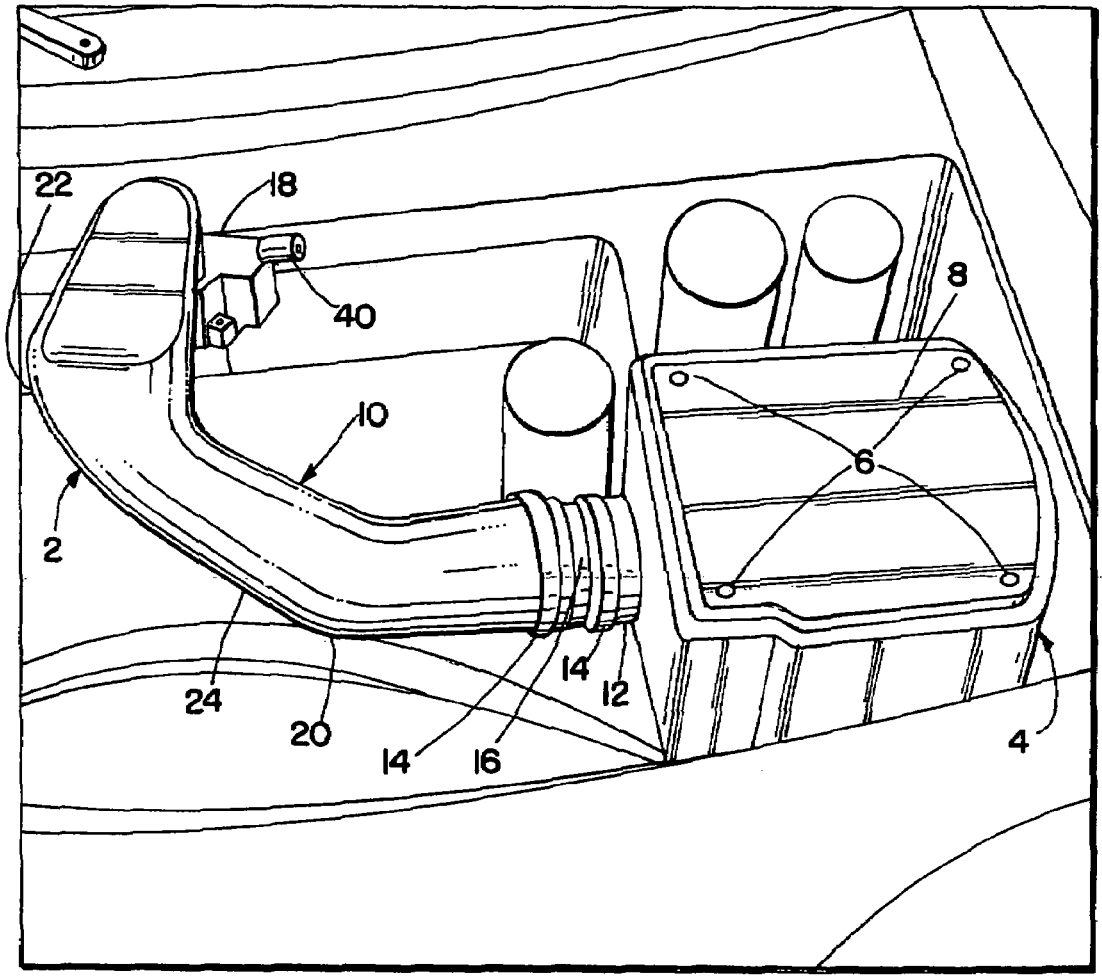
FIG. 1 is a view looking towards the rear of the vehicle showing the installation of the aftermarket intake duct and air filter.
Figure 2:
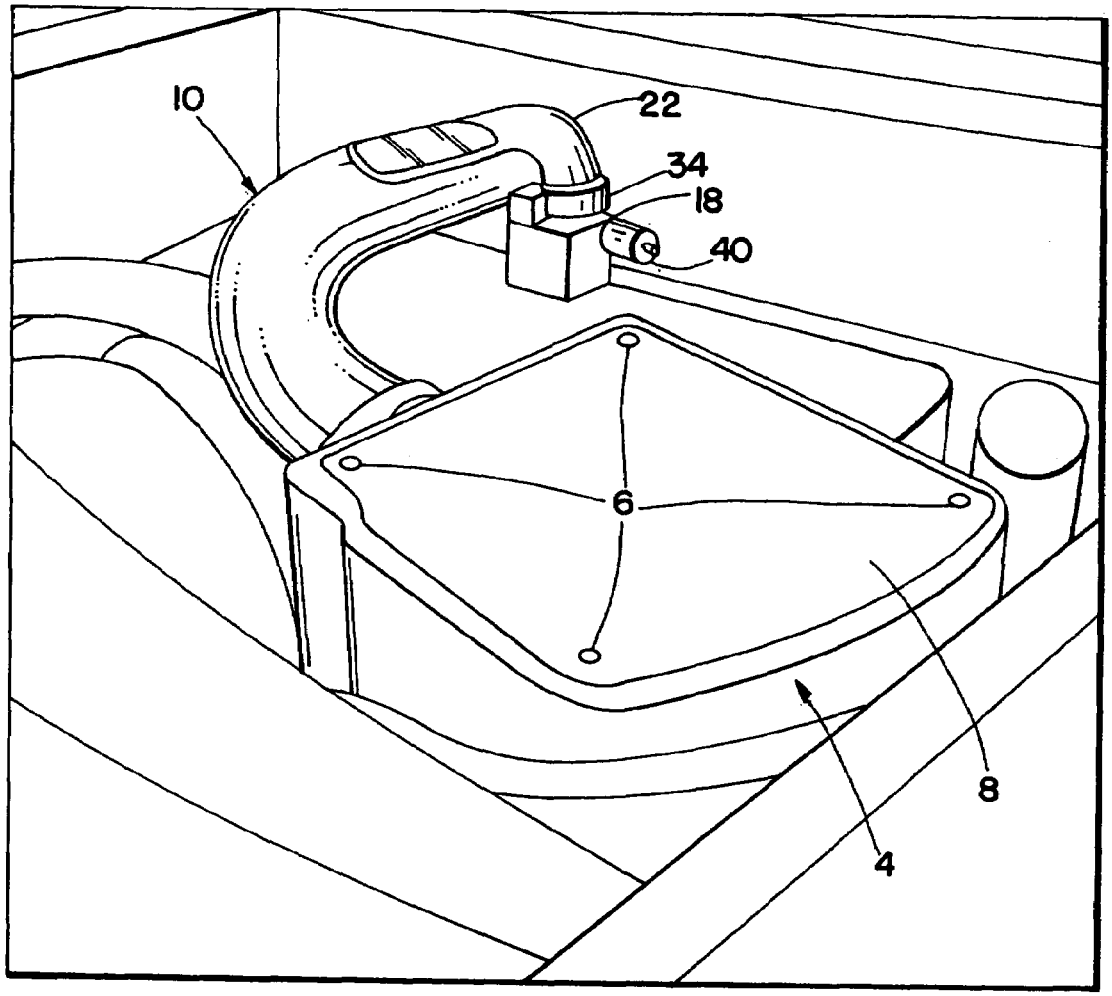
FIG. 2 is a view looking at the left side of the vehicle showing the installation of the aftermarket intake duct and air filter.
Figure 3:
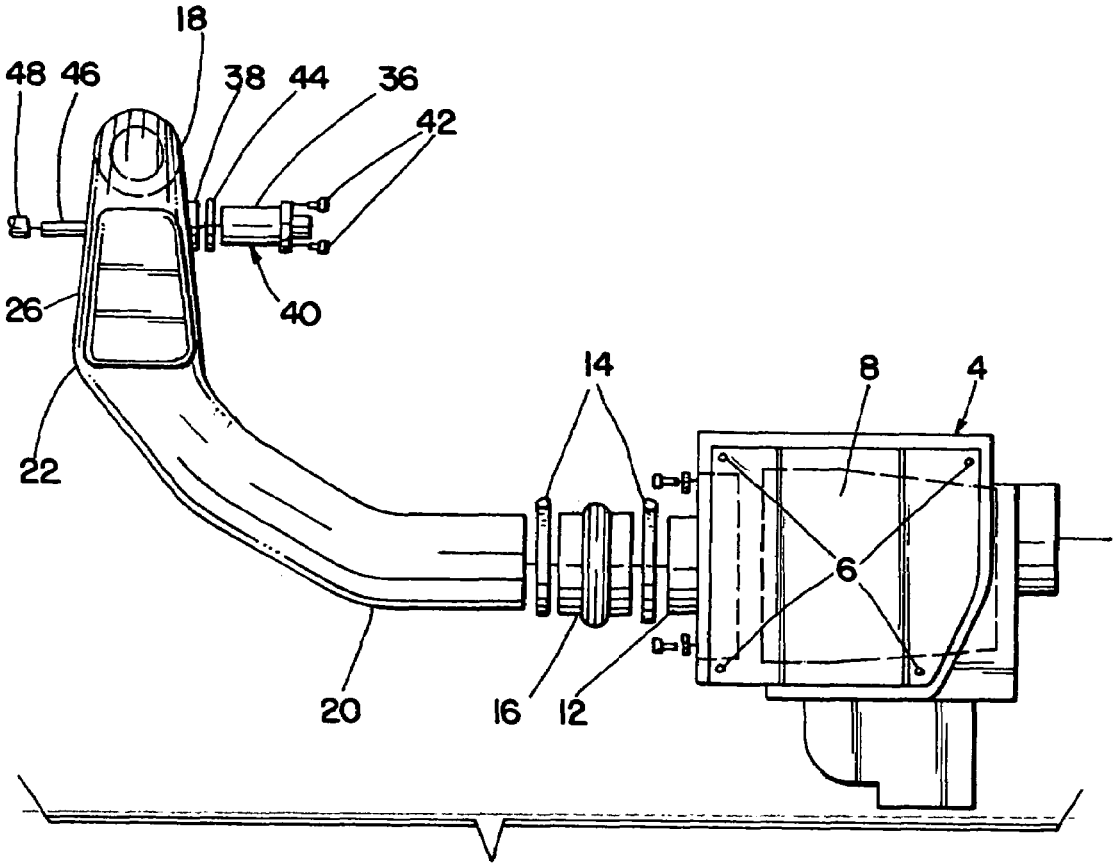
FIG. 3 is a plan view of the duct and air filter installation.
Figure 4:
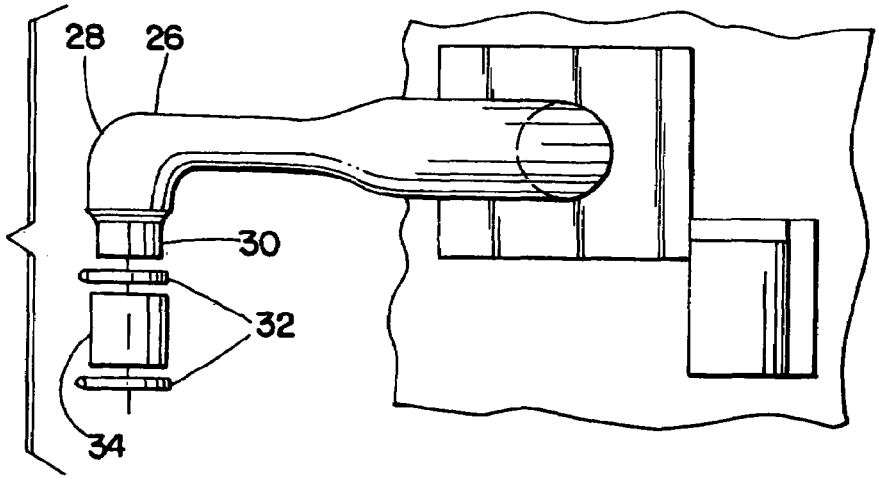
FIG. 4 is a side view of the duct and air filter installation.
Figure 5:
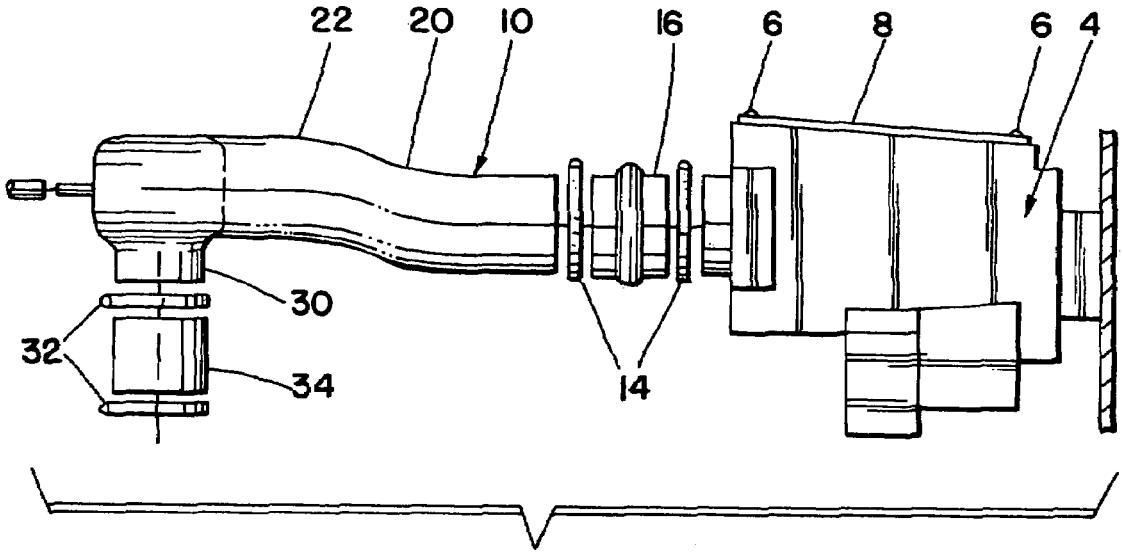
FIG. 5 is an additional side view of the duct and air filter installation

With Respect to FIGS. 1 and 2, what is depicted is an air intake system (2) which comprises a filter box (4). The filter box (4) contains an air filter (not shown) and is adapted to allow air to be inducted into the filter box (4). The filter box (4) is adapted to allow access to the air filter by the use of threaded fasteners (6). The threaded fasteners (6) fasten the filter box lid (8) to the filter box (4) with an air tight seal. The air filters slip fit onto the filter box (4) in a method common within the automotive industry.

An air duct (10) is attached to an outlet (12) of the filter box (4) by clamps (14) and a flexible duct (16). One clamp (14) attaches the flexible duct (16) to the outlet (12) of the filter box (4) and another clamp (14) attaches the flexible duct (16) to the air duct (10). The clamps (14) make an air tight seal, preventing vacuum leaks. The air duct or intake duct (10) is shaped for each specific vehicle, in order to provide a smooth and obstruction free path to the engine intake (18).

For the purposes of illustration, one particular design will be described. As shown in the drawings, the air duct (10) has a first portion (60) and a second portion (62). The first portion (60) and the second portion (62) provide a straight airflow from the filter box (4). A first bend (20) and a second bend (22) in the air duct (10) are connected by a section of tube (24) that positions the air duct (10) in line with the engine intake. A straight portion (26) of the air duct (10) is connected to the second bend (22) and has a ninety degree (90°) bend (28) and positions an exit (30) of the air duct (10) over the engine intake (18). Hose clamps (32) connect a second flexible duct (34) to the exit (30) of the intake duct (10) and the engine intake (18).

Since modern engines are computer controlled, the intake sensors (36) have provisions on the intake duct (10) in order to install them in factory positions. A MAS (Mass Airflow Sensor) boss (38) is integrally formed with the air duct (10). The MAS boss (38) has provisions to allow the Mass Airflow Sensor (40) to be inserted into the air duct (10) in order to measure the air flow. The Mass Airflow Sensor (40) is attached to the air duct (10) using industry standard fasteners (42). Vacuum leaks are prevented by using a MAS gasket (44) between the Mass Airflow Sensor (40) and the boss (38) of the intake duct (10). Opposite the MAS boss (38), a vacuum nipple or breather hose fitting (46) provides an attachment means for an air breather hose (48). The air breather hose (48) is attached to the breather hose fitting (46) in a means common in the automotive industry.

Figure 8:
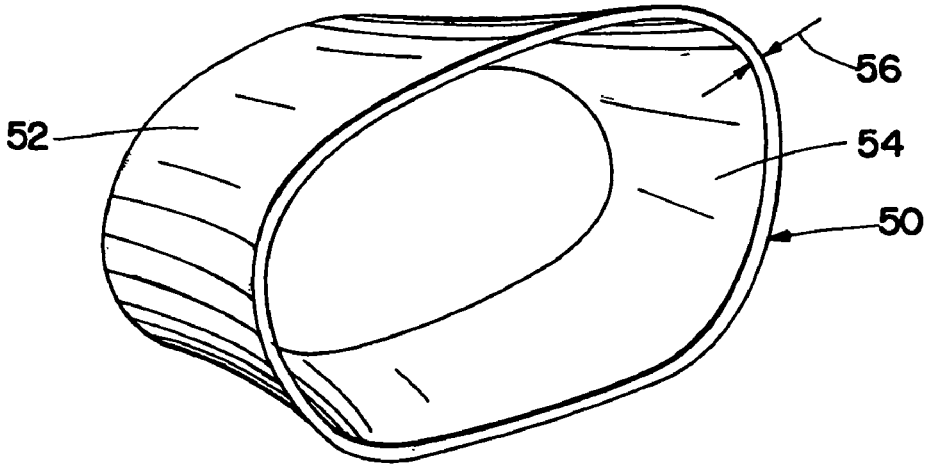
FIG. 8 shows an air intake tube insert.
Figure 9:
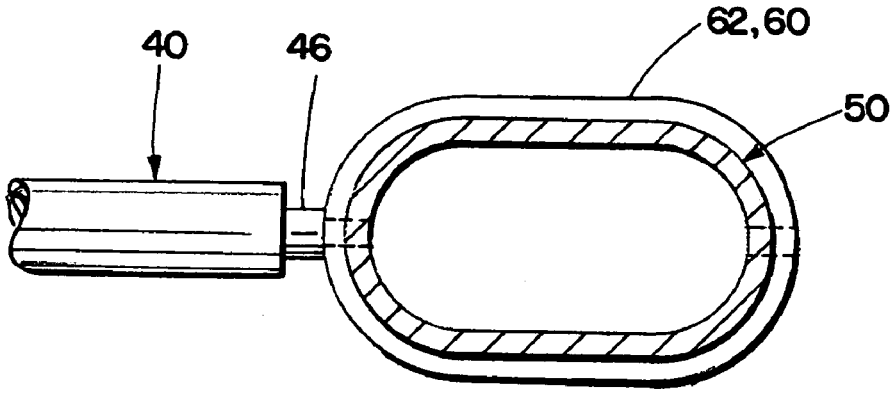
FIG. 9 is a cross section of the air intake tube showing the air intake tube insert.
Figure 10:
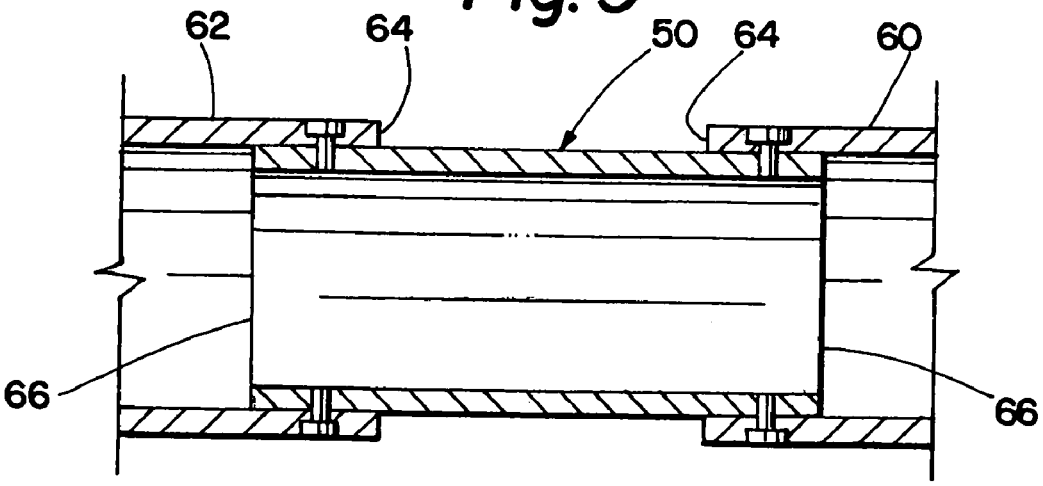
FIG. 10 is a longitudinal cross section of the air intake tube insert and air intake tube.

FIG. 8 shows the insert (50). The insert (50) has an outer surface (52), where the outer surface (52) has a complimentary exterior shape to the interior (54) of the first and second portion (60, 62) of the intake duct (10). This allows for a tight and leak free fit. In order to prevent any possibility of leaks between the insert (50) and the intake duct (10), the insert (50) is welded or glued to the intake duct (10). The insert (50) has a thickness (56) making the insert (50) hollow. The insert (50) reduces the flow area (58) of the intake duct (10) in the vicinity of the MAS (40). The air velocity and air density are increased as prescribed by Bernoulli's Law of Aerodynamics. The resultant increase in air velocity and density allows the MAS (40) to provide the correct air fuel ratios for combustion. Other manufacturers of intake ducts for the same applications do not have this insert and do not make provisions for increasing the velocity of the fuel/air mixture.

Figure 6:
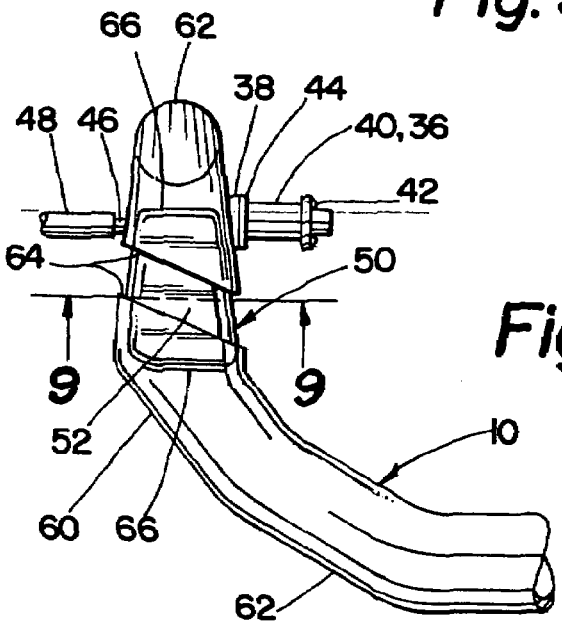
FIG. 6 shows a plan view of an alternative intake duct.
Figure 7:
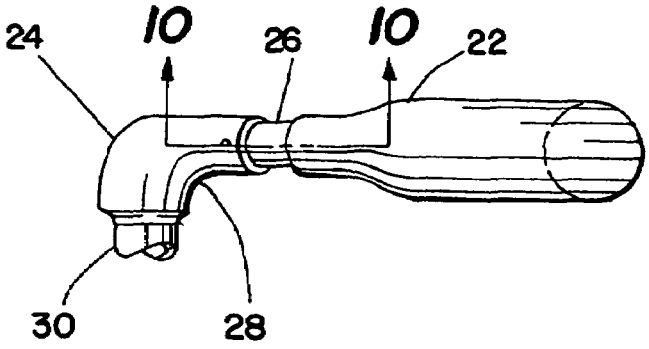
FIG. 7 shows a side view of an alternative intake duct

As shown in FIG. 6, the first portion (60) and the second portion (62) of the intake duct (10) have parallel opposing ends (64) that are diagonally cut. The insert (50) has ends (66) that are generally parallel themselves to the parallel opposing ends (64) of the first portion (60) and the second portion (62). The ends (66) of the insert (50) allow for the gradual increase and subsequent decrease in velocity and air pressure locally within the intake duct (10) thus enhancing smooth airflow within the intake duct (10).

Without the insert (50) in it's proper position, the Mass Airflow Sensor (40) provides an incorrect reading, and hence creates a "lean condition" for the engine, which ultimately damages the engine requiring replacement or rebuilding. At the present time, other manufacturers of aftermarket intake systems do not use an insert, and have damaged customer's engines as a result.

Although the foregoing includes a description of the best mode contemplated for carrying out the invention, various modifications are contemplated.

As various modifications could be made in the constructions herein described and illustrated without departing from the scope of the invention, it is intended _that all matter contained in the foregoing description or shown in the accompanying drawings shall be interpreted as illustrative rather than limiting.

What is claimed is:

1. An air intake duct for motor vehicles, comprising;

a. an air duct, said air duct being adapted to attach to an intake plenum on one end and also being adapted to attach to a motor intake on a second end, said air duct comprising a first portion, a second portion, and an insert, said first and second portion each having an interior surface, said insert having an outer surface, said outer surface of said insert has an exterior shape complimentary to said interior surface of first and second portions of said intake duct, creating a tight and leak free fit, said insert being positionally biased towards said motor intake;

b. said insert has a thickness, said thickness defining a hollow portion thereby, said insert locally reducing the cross sectional area of the intake duct thereby;

c. said air duct has a Mass Airflow Sensor boss, said Mass Airflow Sensor boss is integrally attached thereon, said Mass Airflow Sensor boss is adapted to allow a Mass Airflow Sensor to be inserted into said air duct thereby, said Mass Airflow Sensor is attached to said air duct using industry standard fasteners; and d. said air duct has a vacuum nipple attached, said vacuum nipple being positionally in proximity to said Mass Airflow Sensor Boss, said vacuum nipple being adapted to attach a breather hose fitting, said breather hose fitting being adapted to attach an air breather hose in a means common in the automotive industry.

* * * * *